US006030173A

United States Patent [19]

Bacchiocchi

[11] Patent Number: 6,030,173

[45] Date of Patent: Feb. 29, 2000

[54] SUCTION UNIT FOR HOODS, OVENS AND SIMILAR APPLIANCES HAVING A CASING WITH TWO OR MORE ADJACENT AND SPACED AUGERS

[75] Inventor: Alberto Bacchiocchi, Castelfidardo, Italy

[73] Assignee: F.I.M.E.-Fabrica Italiana Motori Elettrici S.R.L., Italy

[21] Appl. No.: 08/982,865

[22] Filed: Dec. 2, 1997

[30] Foreign Application Priority Data

Dec. 6, 1996 [IT] Italy ..... MC96U0049

[51] Int. Cl.[7] ..... F01D 3/02

[52] U.S. Cl. ..... 415/98; 415/206; 415/102

[58] Field of Search ..... 415/98, 99, 102, 415/103, 116, 206

[56] References Cited

U.S. PATENT DOCUMENTS

| | | | |
|---|---|---|---|
| 1,906,533 | 5/1933 | Burke | 415/98 |
| 3,469,772 | 9/1969 | McDonald | 230/117 |
| 3,856,431 | 12/1974 | Tucker | 415/98 |

*Primary Examiner*—Edward K. Look
*Assistant Examiner*—Richard Woo
*Attorney, Agent, or Firm*—Leonard Bloom

[57] ABSTRACT

This invention concerns a suction unit for hoods, ovens and similar appliances consisting of a double auger casing in which the two augers are adjacent but spaced so that two separate suction inlets may be realized on the same, one on the external side and the other on the internal side.

6 Claims, 4 Drawing Sheets

SUCTION UNIT FOR HOODS, OVENS AND SIMILAR APPLIANCES HAVING A CASING WITH TWO OR MORE ADJACENT AND SPACED AUGERS

BACKGROUND OF THE INVENTION

1. Field of the Invention

This patent application concerns a suction unit for hoods, ovens and similar appliances having two or more fans housed in respective adjacent and spaced augers.

This invention concerns a powerful suction unit of the type having a single electric motor driving several fans.

2. Description of the Related Art

In the suction units of this type currently available on the market, the ends of a shaft on which two fans are splined project from the sides of said motor; each fan consisting of a disk supporting a series of blades having horizontal axis facing the side opposite the motor.

Currently suction units of this kind are provided with a special casing consisting of two separate adjacent augers positioned close against each other; it being provided that the motor driving both fans is flush mounted at the centre of said casing.

Each side of said casing is provided with an opening (or suction inlet) through which the external air is drawn into each auger by the respective fan. Considering that the internal compartment of each auger is separated from the internal compartment of the adjacent auger, it is evident that each auger uses only one air suction inlet: namely the opening on the external side.

Moreover said positioning of the suction inlets is also the reason for which the blades of the two fans of conventional suction units are turned towards the external side of the casing.

It should be remembered in passing that the outlet of each of these conventional augers is provided with a hole through which the air previously drawn through the side inlet is discharged.

SUMMARY OF THE INVENTION

The scope of this invention is to improve the performance and operating method of said double auger suction units.

In particular this has been achieved by designing a special casing which can house a motor and relevant pair of fans mounted at its sides, characterised by the use of two adjacent but spaced augers so that a space is formed between the same.

The decision to space the two augers also led to the creation of a second suction inlet on each of the same.

This means that each of said new augers may use two separate suction inlets; the first inlet, namely the traditional inlet, is realised in proximity of the external side while the second inlet, namely the new inlet, is realised on the internal side, namely on the same side housing the motor.

In this respect it is evident that the internal sides of the two augers as well as their relevant openings are placed—in the case of the casing according to the invention—in an opposing position but spaced from the above space.

It should be noted that the presence of two suction inlets on each auger is extremely important in terms of operation and performance of the double fan suction unit.

It is evident that in the case of the unit according to the invention each auger casing thanks to its two suction inlets will have—at the same conditions (power and motor r.p.m., auger dimensions etc.)—a significantly greater suction capacity with respect to conventional units.

Moreover it should be noted that the major air flow which obviously occurs in the new augers, with respect to that occurring in conventional augers having a single suction inlet, permits the former to have the same suction capacity as the second with the motor running at a lower speed and thus ensuring an energy saving and lower noise level.

It should also be noted that the two side inlets on each auger has permitted the use of special fans; in fact each of these fans is of the type consisting of a centre disk having a series of respective perimeter fins on both sides.

It follows that each fan mounted on the new suction unit in question uses a series of fins turned towards the external side of the respective auger and a second identical series of fins turned toward the internal side of the same auger.

Finally it should be noted that the presence of the above space between the two augers does not alter the transverse dimensions of the casing, whose outflow outlet may be fitted directly without the use of a manifold or pipe fitting, to the pipe through which air is discharged to the exterior.

This characteristic of the unit according to the invention is particularly important in that in this way it is perfectly interchangeable with conventional suction units, with respect to which however it has a major flow, greater head and better performance at the same absorbed power and vice versa.

Attention is also drawn to the fact that all the above advantages and features—deriving from the idea to use two adjacent but spaced augers—increase as the number of adjacent spaced augers increases.

For major clarity the description continues with reference to the enclosed drawings which are intended for purposes of illustration and not in a limiting sense and which illustrate two structurally different embodiments of the same invention, one consisting of two adjacent and spaced augers and the other consisting of three adjacent and spaced augers.

BRIEF DESCRIPTION OF THE DRAWINGS

FIGS. 1 and 2 refer to the first embodiment while

FIGS. 1 and 3 are two axonometric views of the fan-motor according to the invention in the above two structural embodiments;

FIGS. 2 and 4 are the cross-section of the casing housing the fan-motor illustrated respectively in FIGS. 1 and 3.

DESCRIPTION OF THE PREFERRED EMBODIMENTS

Figure 1:
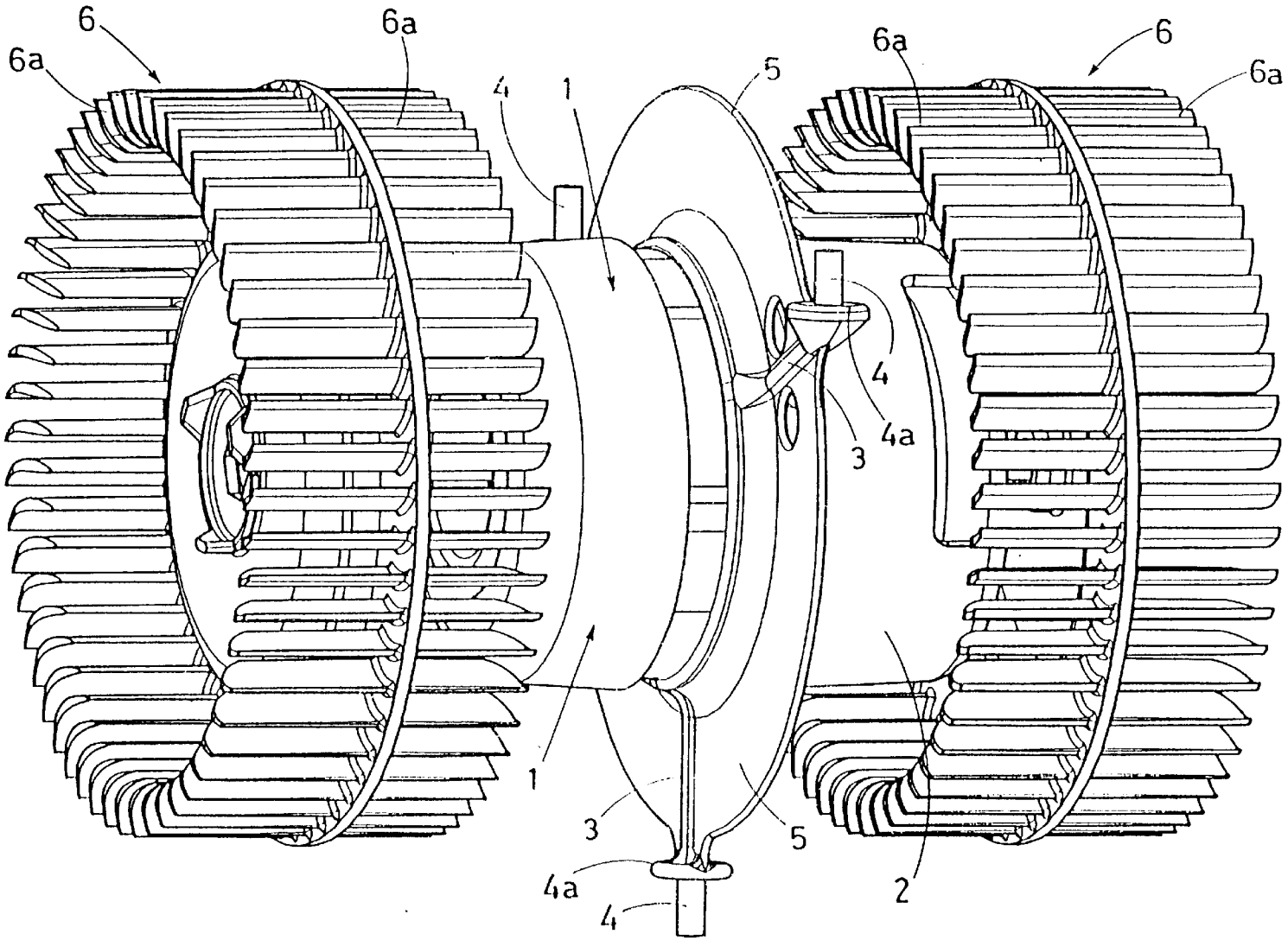

With reference to FIG. 1, the motor (1) of the suction unit in question is in part housed in a cylindrical cover (2) provided externally with three radial arms (3) placed at 120° two of which are turned upward and one is turned downwards, all terminating with respective pins having vertical axis (4) each with enlarged end base **(4*a*)**.

In the case of the embodiment according to the invention illustrated in FIG. 1, said radial arms (3) are incorporated in a disk (5) realised outside the cylindrical cover (2).

Two fans (6) of the type consisting of a ring having a respective series of blades **(6*a*) on its two faces are splined at the ends of the through shaft of the motor (1)—namely on the right and on the left of the motor (1)**.

Figure 2:
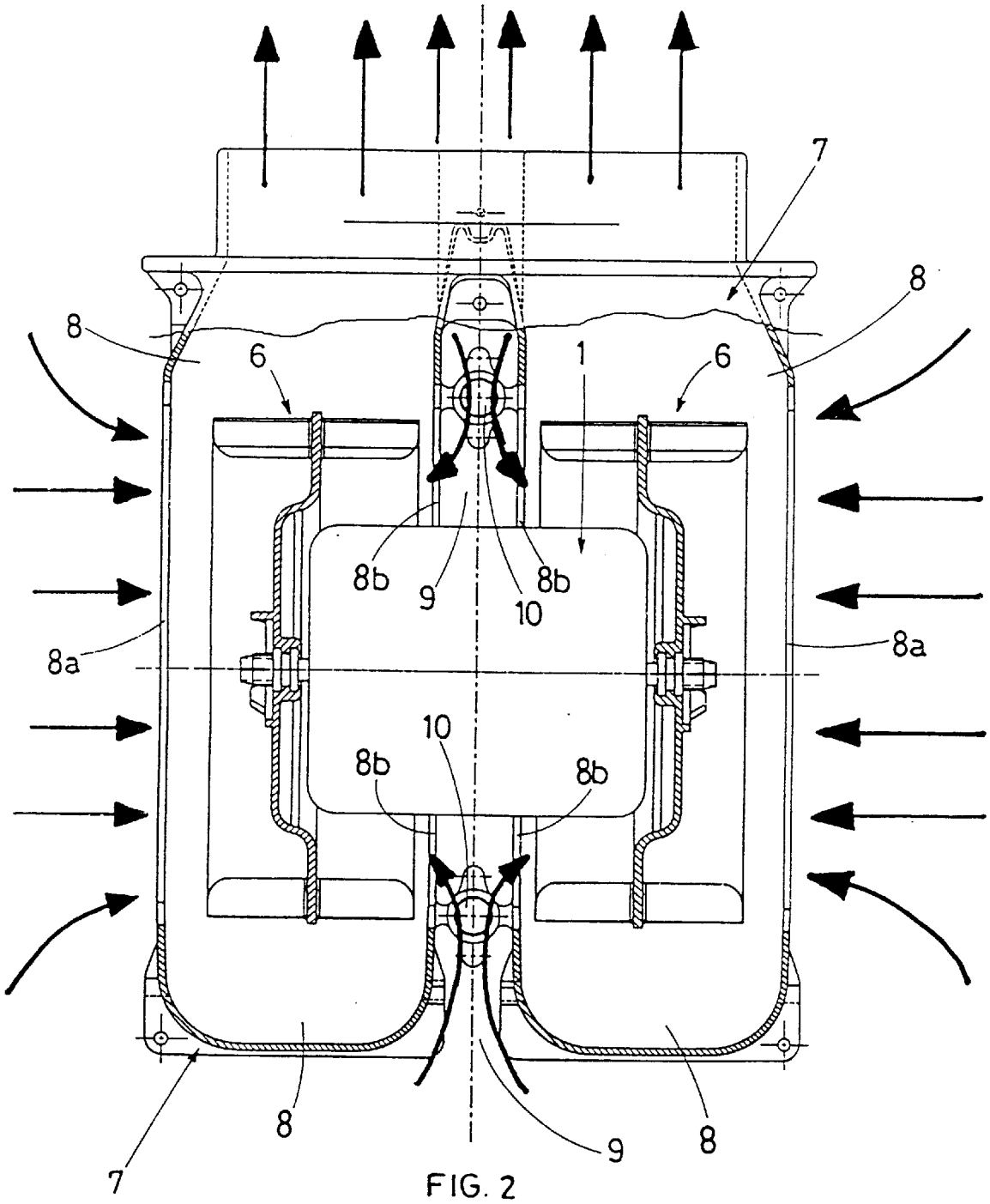

With reference to FIG. 2, the casing (7) consists of two adjacent augers (8) spaced by a gap (9).

Both the sides of each auger (8) are provided with suction inlets (8*a* and 8*b*), the first (8*a*) on the external side and the second (8*b*) on the internal side.

FIG. 2 shows the arrows illustrating the flow of air drawn through both the two external suction inlets (8*a*) and through the two suction inlets (8*b*).

The number (10) refers to two of the three bushings fitted in the space (9) designed to house the pins (4) provided at the ends of the radial arms (3) projecting from the cover (2) to ensure secure fixing of the fan-motor unit to the casing (7).

It is evident that the above disk (5) provided on the exterior of the cylindrical cover (2) is positioned between the two opposing inlets (8*b*) provided in proximity of the internal sides of each auger (8); said disk (5) has an accident prevention function, namely that of preventing the operator from inserting a finger into said suction inlets.

Figure 3:
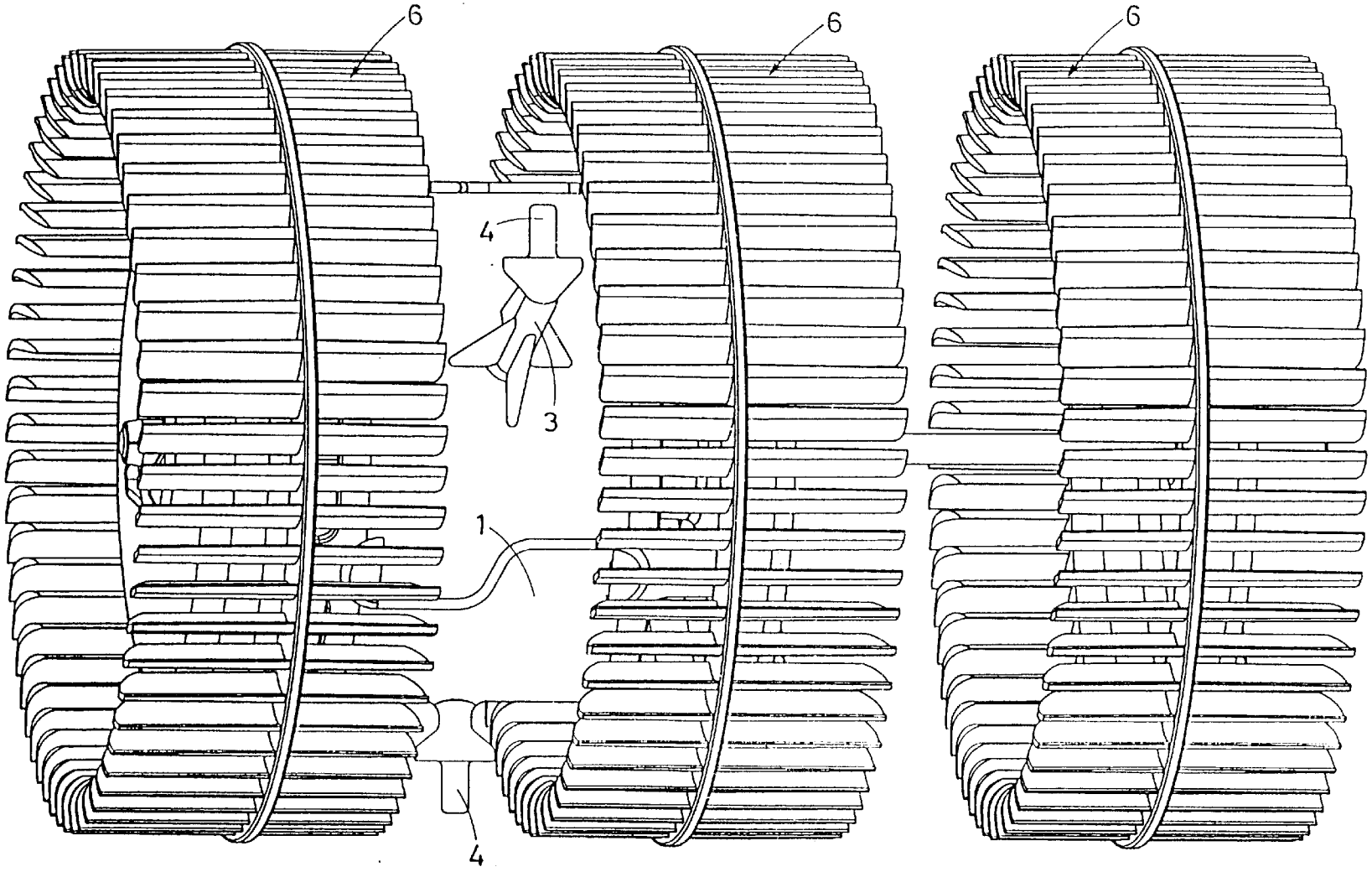
FIGS. 3 and 4 refers to the second embodiment.
Figure 4:
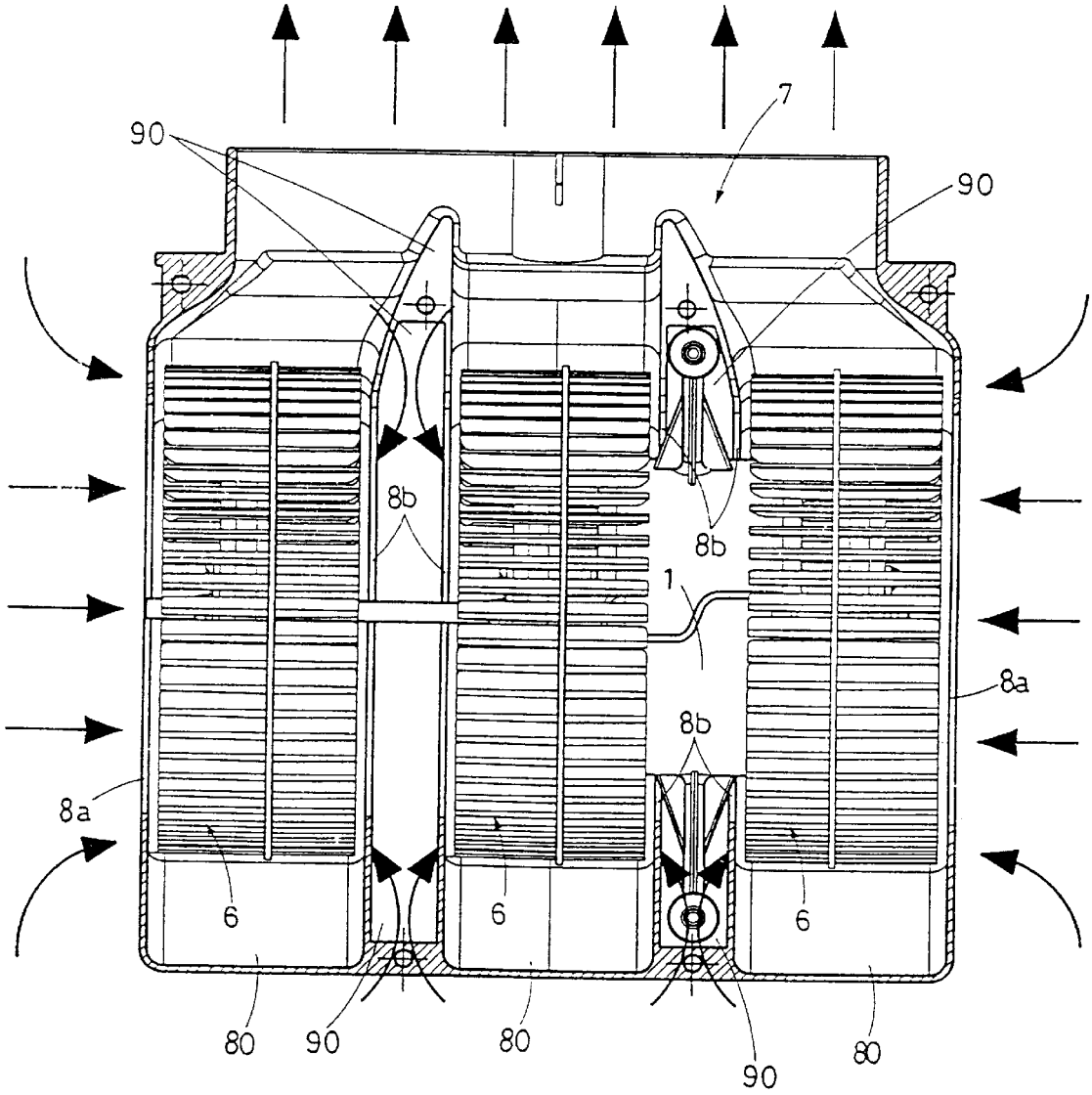

A detailed description of FIGS. 3 and 4 is not considered to be necessary in that the only difference in the second structural embodiment of the invention with respect to the first embodiment is the use of three spaced and adjacent augers (80) separated by respective spaces (90).

In the second embodiment there are three fans (6) despite the fact that there is only one motor (1).

In this regard it should be noted that the same numbers used in FIGS. 1 and 2 were used in FIGS. 3 and 4 to illustrate the corresponding structural components in the first and second embodiments of the invention.

I claim:

1. A suction unit comprising:

an electric motor (1) housed in a cylindrical cover (2), the motor having a through shaft having opposite ends extending outwardly from the motor, a first fan (6) splined to one end of the through shaft and a second fan (6) splined to the opposite end of the through shaft, the motor being between the first fan and the second fan, a first auger (8) and an adjacent second auger (8), the motor being disposed partially in each of the augers, the first fan being disposed in the first auger and the second fan being disposed in the second auger, the first auger and the second auger having a space (9) therebetween, the first auger and the second auger defining a casing (7), the first auger and the second auger each having an external side, each external side being provided with a suction inlet (8*a*), the first auger and the second auger each having an internal side in the space between the first auger and the second auger, each internal side being provided with a suction inlet (8*b*) such that four suction inlets are provided, a single outflow outlet formed in the casing wherein outflow from the first fan and outflow from the second fan are combined.

2. The suction unit of claim 1, wherein each fan has two series of blades (6*a*), one series of blades oriented toward the suction inlet (8*a*) on the external side of the respective auger (8) and the other series of blades oriented toward the suction inlet (8*b*) on the internal side of the auger (8) in which the respective fan is disposed.

3. The suction unit of claim 1, wherein the cylindrical cover for the motor has a disk (5) formed radially thereabout, the disk having incorporated therein, three arms, the arms being disposed at 120° with respect to each other, each arm having an end distal from the motor, a respective pin being formed on the end of each arm, each pin being connected to the casing to secure the motor thereto.

4. A suction unit comprising:

an electric motor (1) housed in a cylindrical cover (2), the motor having a through shaft having opposite ends extending outwardly from the motor, a first fan (6) splined to one end of the through shaft, a second fan (6) splined to a portion of the through shaft opposite from the first fan and a third fan (6) splined to the opposite end of the through shaft adjacent to the second fan, the motor being between the first fan and the second fan, a first auger (80), an adjacent second center auger (80) adjacent to the first auger and a third auger (80) adjacent to the second auger and distal from the first auger, the motor being disposed partially in each of the first and second augers, the first fan being disposed in the first auger, the second fan being disposed in the second auger and the third fan being disposed in the third auger, the first auger and the second auger having a first space (90) therebetween, the second auger and the third auger having a second space (90) therebetween, the first auger, the second auger and the third auger defining a casing (7), the first auger and the third auger each having an external side, each external side being provided with a suction inlet (8*a*), the first auger having an internal side and the second auger having a first internal side in the space between the first auger and the second auger, the internal side of the first auger and the first internal side of the second auger each being provided with a suction inlet (8*b*), the second auger having a second internal side and the third auger having an internal side in the space between the second auger and the third auger, the second internal side of the second auger and the internal side of the third auger each being provided with a suction inlet (8*b*) such that four suction inlets are provided, a single outflow outlet formed in the casing wherein outflow from the first fan, outflow from the second fan and outflow from the third fan are combined.

5. The suction unit of claim 4, wherein each fan has two series of blades (6*a*), the first fan and the third fan each having one series of blades oriented toward the suction inlet (8*a*) on the external side of the respective auger (80) and the other series of blades oriented toward the suction inlet (8*b*) on the internal side of the auger (80) in which the respective fan is disposed, the second fan having one series of blades oriented toward the suction inlet in the first internal side and the other series of blades oriented toward the suction inlet on the second internal side.

6. The suction unit of claim 4, wherein the cylindrical cover for the motor has a disk (5) formed radially thereabout between the first fan and the second fan, the disk having incorporated therein, three arms, the arms being disposed at 120° with respect to each other, each arm having an end distal from the motor, a respective pin being formed on the end of each arm, each pin being connected to the casing to secure the motor thereto.

* * * * *